US008544842B2

(12) United States Patent
Schulze-Hagenest et al.

(10) Patent No.: US 8,544,842 B2
(45) Date of Patent: Oct. 1, 2013

(54) SHEET TRANSPORT DEVICE

(75) Inventors: Detlef Schulze-Hagenest, Molfsee (DE); Soenke Dehn, Daenischenhagen (DE); Eckhard Bauer, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/378,444

(22) PCT Filed: Jun. 10, 2010

(86) PCT No.: PCT/EP2010/058156

§ 371 (c)(1), (2), (4) Date: Mar. 6, 2012

(87) PCT Pub. No.: WO2011/000678

PCT Pub. Date: Jan. 6, 2011

(65) Prior Publication Data

US 2012/0153563 A1 Jun. 21, 2012

(30) Foreign Application Priority Data

Jun. 30, 2009 (DE) ..... 10 2009 031 115

(51) Int. Cl.
*B65H 29/32* (2006.01)
*B65H 5/02* (2006.01)
*B65H 39/10* (2006.01)

(52) U.S. Cl.
USPC ..... 271/197; 271/194; 271/276; 271/302; 271/303

(58) Field of Classification Search
USPC ..... 271/194–197, 302, 303, 276
See application file for complete search history.

(56) References Cited

U.S. PATENT DOCUMENTS

| | | | | |
|---|---|---|---|---|
| 3,140,780 | A * | 7/1964 | Eberhard et al. | 198/438 |
| 3,659,840 | A * | 5/1972 | Ruck | 271/279 |
| 3,717,249 | A * | 2/1973 | Faley | 209/552 |
| 3,827,548 | A | 8/1974 | Matsuo | |
| 4,850,581 | A | 7/1989 | Hayakawa et al. | |
| 6,450,711 | B1 | 9/2002 | Conrow | |
| 6,460,844 | B1 * | 10/2002 | Clifford et al. | 271/9.13 |
| 7,584,957 | B2 * | 9/2009 | Edinger | 271/197 |
| 7,980,558 | B2 * | 7/2011 | Moore et al. | 271/276 |
| 8,047,535 | B2 * | 11/2011 | Nishimura et al. | 271/197 |
| 2003/0184008 | A1 * | 10/2003 | Ingelsten | 271/196 |
| 2004/0164482 | A1 * | 8/2004 | Edinger | 271/197 |
| 2005/0156376 | A1 | 7/2005 | Kondratuk et al. | |
| 2007/0069458 | A1 | 3/2007 | Watanabe | |

FOREIGN PATENT DOCUMENTS

| | | |
|---|---|---|
| DE | 2 208 339 | 9/1972 |
| DE | 87 17 360 | 2/1989 |
| DE | 10 2007 007 813 | 1/2008 |

(Continued)

*Primary Examiner* — Patrick Cicchino
(74) *Attorney, Agent, or Firm* — Kevin E. Spaulding; Christopher J. White

(57) ABSTRACT

The invention relates to a sheet transport device (1) comprising a first and a second opposing transport units (3, 5), each comprising at least one circulating conveyor belt (15) and one vacuum suction device (9, 11) that is in relation with the conveyor belt, said vacuum suction devices being individually actuatable so as to attract a sheet (19), located between the transport units, to the one or the other conveyor belt. Such a sheet transport device is used, for example, in a printing machine. The invention also relates to a method for transporting a sheet to this sheet transport device.

23 Claims, 3 Drawing Sheets

(56) References Cited

FOREIGN PATENT DOCUMENTS

| | | |
|---|---|---|
| EP | 0 015 392 | 9/1980 |
| EP | 0 121 432 | 10/1984 |
| JP | 60-052455 | 3/1985 |

* cited by examiner

SHEET TRANSPORT DEVICE

FIELD OF THE INVENTION

The invention relates to a sheet transport device with vacuum suction, said sheet transport device being suitable for selectively guiding a sheet along a sheet transport path and also allowing a sheet jam bypass. Such a sheet transport device can be used, for example, for transporting sheets in a printing machine.

BACKGROUND OF THE INVENTION

From document JP 60052455 A, a paper path switching device is known, in which a paper sheet to be transported is guided past air-transmissive vacuum rollers that are arranged above and below a paper path. One of the vacuum rollers attracts the paper sheet and selectively guides said paper sheet to one of two branch paths that are provided on opposite sides of the paper path in this paper path switching device.

This known paper path switching device has the disadvantage that a paper sheet is only guided along a line of contact with one of the air-transmissive vacuum rollers on its sheet transport path. Consequently, the sheet may form waves upstream and downstream of this line of contact, and sheet jams may easily occur, thus leading to production down times.

SUMMARY OF THE INVENTION

It is the object of the present invention to make available a sheet transport device that provides secure guiding for a sheet that is to be transported.

The object of the present invention is achieved by a sheet transport device in accordance with Claim 1 and by a method in accordance with Claim 20.

In particular provided is a sheet transport device comprising first and second oppositely arranged transport units, each of said transport units comprising at least one circulating conveyor belt and a vacuum suction device that is in relation with the conveyor belt. Said vacuum suction devices can be individually actuated so as to attract a sheet, located between the transport units, to the one or the other conveyor belt. This offers the advantage that the sheet is guided in a stable and steady manner and that the probability of a sheet jam is decreased.

Advantageously, the transport units are at a distance from each other such that one transport unit can transport a sheet independently of the respectively other transport unit. Thus a second sheet can be transported past a first sheet if the first sheet is stuck or transported more slowly than the second sheet.

Preferably, the vacuum suction devices comprise a mechanism for applying different vacuum pressures to different regions of the conveyor belt. As a result of this, an inadvertent suction of a sheet from the opposite transport unit is avoided.

This mechanism is preferably suitable for sequentially applying a vacuum to adjacent regions of the conveyor belt and has the advantage that the regions to which a vacuum has been applied can be controlled synchronously with respect to the conveying motion of the sheet. Consequently, the conveyor belt can aspirate the sheet only in the region that is covered by the sheet.

Advantageously, the vacuum suction device of the transport units comprises a suction chamber that communicates with a variably controllable vacuum source, which makes the variable adjustment of the vacuum possible. In order to make possible a position-dependent activation of the transport unit with a vacuum, a suction chamber having several partitions may be provided, said partitions being selectively connectable to the vacuum source. The vacuum suction device may also comprise a suction chamber communicating with a vacuum source, said suction chamber having at least one suction opening that can be variably opened and closed. By way of this, the vacuum can be controlled in a simple manner. The suction opening that is to be variably opened and closed may comprise a variable bypass opening in order to optionally decrease the vacuum locally. For the variable opening and closing of the at least one suction opening, preferably a flap, a valve and/or a circulating, partially air-transmissive, control web is provided, as a result of which an adjustment of the vacuum can be achieved with simple standard components in various regions of the transport units.

The vacuum suction devices of the opposing transport units preferably comprise connection and disconnection features that are logically locked with respect to each other in such a manner that in opposite regions a vacuum is applied to only one of the transport units while no vacuum or only a minimal vacuum is applied to the other transport unit in the corresponding region. This means, for example, that—in a region of a conveyor belt of one transport unit that is covered by the sheet—a high vacuum is applied, whereas, at the same time—in the corresponding opposite region of the other conveyor belt that is not covered by a sheet—a slight vacuum is applied. This offers the advantage that a sheet conveyed by the one transport unit is not drawn over to the opposite other transport unit.

Preferably, the sheet transport device comprises two sheet transport outlets that are aligned with respectively one of the transport units, so that a sheet conveyed by one transport unit is guided in the sheet transport outlet aligned therewith. Thus the sheet is guided securely and with a steady conveying movement to the sheet transport outlet.

Each of the sheet transport outlets communicates with a separate sheet transport path, said paths continuing either separately or leading back together into a joint sheet transport path. This results in the advantage that the sheet transport device can be operated as a sheet switch and also as a bypass device.

Advantageously, the sheet transport device comprises at least one sheet feeding unit that is arranged so as to convey a sheet between the first and the second transport units resulting in that the sheet can be easily drawn toward one of the transport units.

In one embodiment, at least two transport units are sequentially provided in transport direction of the sheets. As a result of this, it is possible to bridge longer transport paths.

In the sheet transport device, preferably at least one of the transport units can be moved at least partially away from the opposite transport unit for removing a sheet jam or for performing maintenance work. The movement of the transport unit may either be a pivoting movement or a linear movement.

Preferably, sheet sensors are provided for sensing a sheet position, and an activation of the vacuum suction device may take place as a function of the output parameters of the sheet sensors. As a result of this, a selective suction of the sheets may be achieved. In particular, it is possible to detect and, if necessary, bypass a sheet jam.

Furthermore, the object is achieved by a method for transporting a sheet from a sheet conveyor unit to one of two sheet transport outlets of a sheet transport device comprising first and second transport units with vacuum suction devices, said devices being arranged opposite each other. With this method, depending on the sheet transport outlet to which the sheet is to be conveyed, the vacuum suction device of the first or second transport unit is activated in order to draw the sheet by suction to a circulating conveyor belt of the transport units and to convey said sheet to a sheet transport outlet. This leads to the sheet being guided in a steady manner and the probability of a sheet jam being reduced.

The method may comprise the feeding of a first sheet between the two transport units comprising a vacuum suction device and comprise the detection of a sheet jam in the region of a first one of the transport units. Subsequently, a second sheet is inserted between the two transport units, and the second sheet is drawn by suction to the second transport unit and conveyed with the second transport unit. As a result of this, a sheet may be guided past a stuck second sheet, and operation may be upheld.

The step of detecting a sheet jam advantageously comprises the measurement of the position of a sheet and/or the measurement of the speed of a sheet. As a result of this, it is possible to quickly detect a sheet jam, and suction via the conveyor belt can be influenced.

Preferably, the method comprises the step of an at least partial downward adjustment of the vacuum suction device of the transport unit that does not transport the sheet. The step of downward adjustment comprises, in particular, a reduction of the vacuum level. As a result of this, it is avoided that a sheet transported by the other transport unit is aspirated, which would cause problems.

Advantageously, the step of downward adjustment comprises a reduction of the vacuum level in partial regions of the vacuum suction device. By individually decreasing the vacuum, it is possible to generate a vacuum effect over the length of the transport device, said effect being high wherever the sheet is seated on the transport device and being low wherever the sheet is not seated on the transport device. It is thus possible to achieve a concentration of the vacuum in the region where a conveyed sheet is currently located.

Advantageously, the vacuum suction device comprises a suction chamber with several partitions, and the step of downward adjustment provides for a reduction of the vacuum at least in one of these partitions. The partitions offer the simple option of defining regions of the suction chamber and, thus, also of the transport unit, with different vacuum levels.

In one embodiment, the suction chamber has at least one variable suction opening, and the step of downward adjustment provides for the variable opening of this suction opening. This enables the operation of several suction chambers with one common vacuum source, while the vacuum in the individual chambers can be rapidly adjusted.

BRIEF DESCRIPTION OF THE DRAWINGS

The invention, as well as additional details and advantages thereof, will be explained hereinafter with reference to preferred exemplary embodiments and to the figures. They show in FIG. 1 a schematic side view of a sheet transport device in accordance with one exemplary embodiment of the present invention in a first mode of operation.

DETAILED DESCRIPTION OF THE INVENTION

Figure 1:
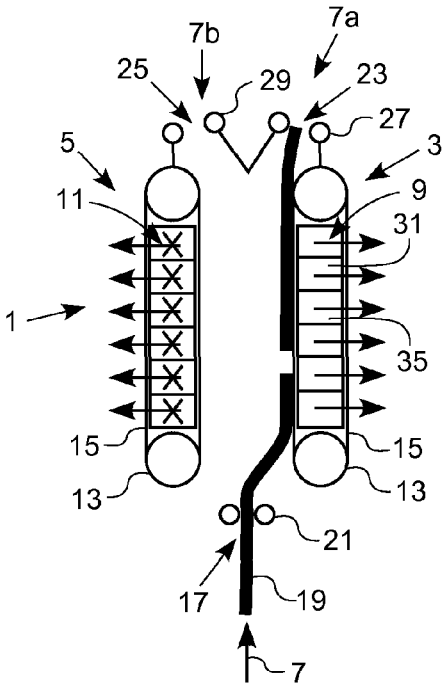

It should be noted that statements such as right, left, top, bottom and similar statements relate to the figures and are not to be understood to have a restrictive meaning. Furthermore, expressions such as, for example, leading/trailing sheet or similar expressions relate to a transport direction or conveying direction of a sheet. This conveying direction extends from the bottom to the top in the figures.

A sheet transport device 1 in accordance with the present invention comprises a first transport unit 3 and a second transport unit 5, said transport units being arranged opposite each other on two sides of a sheet transport path 7, and facing each other. The first transport unit 3 comprises a first vacuum suction device 9, and the second transport unit 5 comprises a second vacuum suction device 11.

Each of the two transport units 3, 5 comprises two transport rollers 13, as well as a circulating, air-transmissive conveyor belt 15, to which a vacuum can be applied by the respective vacuum suction device 9 or 11. At least one of the transport rollers 13 of a transport unit 3, 5 is driven. Furthermore, it should be noted that a transport unit 3, 5 may be provided with more than two transport rollers 13. Such a transport unit 3, 5 is also referred to as a suction belt mechanism.

Furthermore, the sheet transport device 1 comprises a sheet transport inlet 17 that is located adjacent to the transport units 3, 5 and from which the sheets 19 are transported to the sheet transport device 1. The sheets 19 are supplied, for example, by a (not illustrated) sheet feeding unit, to the sheet transport inlet 17. The sheet transport inlet 17 comprises two sheet transport inlet rollers 21, between which a sheet 19 is guided and by which the sheet 19 is transported in the direction of the sheet transport path 7. The sheet transport inlet 17 is arranged in such a manner that a conveyed sheet 19 arrives between the transport units 3, 5. The vacuum suction devices 9, 11 can be selectively activated, and the sheet 19 can be drawn by suction through the activated vacuum suction device 9 or 11 toward the respective corresponding transport unit 3 or 5.

The figures show that the sheet 19 is fed in the center between the transport units 3, 5. Alternatively, the sheet 19, however, may also be fed outside the center between the transport units 3, 5, if it is ensured that said sheet can be aspirated by an activated vacuum suction device 9 or 11 and drawn by suction to the corresponding transport unit 3 or 5.

It should be noted that, in another exemplary embodiment of the sheet transport device 1, it is also possible to provide several sheet transport inlets 17, these supplying different types of sheets, for example. This plurality of sheet transport inlets 17 is arranged in such a manner that a conveyed sheet 19 enters between the transport units 3, 5 and into the region of action of the vacuum suction devices 9, 11. Depending on which of the vacuum suction devices 9, 11 is selectively activated, the sheet 19 is then drawn by suction to the corresponding transport unit 3 or 5.

Furthermore, the sheet transport device 1 comprises a first sheet transport outlet 23 and a second sheet transport outlet 25. The first sheet transport outlet 23 is aligned with the first transport unit 3 and comprises two opposing sheet transport output rollers 27. The second sheet transport outlet 25 is aligned with the second transport unit 5 and comprises two opposing sheet transport output rollers 29. The sheet transport outlets 23, 25 are aligned with their respective transport units 3, 5 in such a manner that a sheet 19 conveyed by a transport unit 3, 5 is guided into the associate sheet transport outlet 23, 25 and can thus be grasped by the opposing sheet transport output rollers 27 or 29.

In accordance with one exemplary embodiment, the sheet transport outlets 23, 25 lead to different, continuing sheet paths 7*a*, 7*b*. This may be the case, for example, in a sorting unit or when a sheet switch is used.

Alternatively, the sheet transport outlets 23, 25 may also lead to sheet paths 7*a*, 7*b* that meet after a section of the path in order to again be united to form a single sheet path 7. This may be the case when a sheet 19 is to be guided around a sheet jam in the region of one of the sheet transport outlets 23, 25. Another example would be if a part of the sheets 19 is to be selectively guided to a processing device in one of the sheet paths 7*a*, 7*b* in order to be guided back on the same sheet path 7 for further processing.

Although the transport units 3, 5 in the figures are shown in a manner extending parallel to each other, an alternative embodiment is being taken into consideration, in which the transport units 3, 5 are at closer distances with respect to each other in the vicinity of the sheet transport inlet 17 than in the vicinity of the sheet transport outlets 23, 25. Consequently, the result is a V-shaped configuration of the transport units 3, 5, where the sheet transport outlets 23, 25 are at a greater distance from each other than is shown in FIGS. 1 through 4.

Furthermore, it should be noted that several transport units 3, 5 may be sequentially provided on one side or on both sides of the sheet transport path 7 in the direction of the sheet transport path 7. This, for example, depends on the length of the sheet transport path, the type of vacuum suction device and on whether one of the transport units 3, 5 can be pivoted or shifted.

Figure 5A:
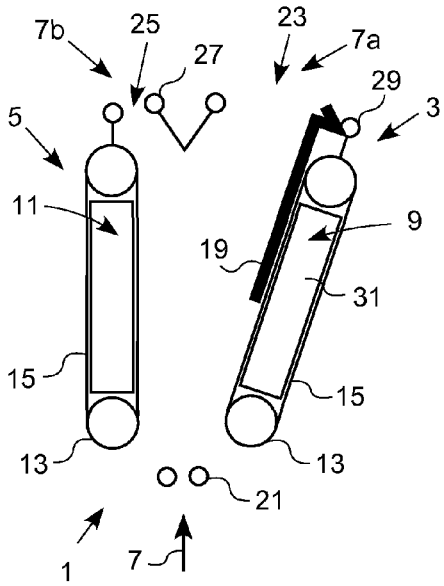
FIG. 5*a* a schematic side view of a sheet transport device in accordance with one exemplary embodiment of the present invention, said sheet transport device comprising a pivot opening mechanism for access to a sheet transport path.
Figure 5B:
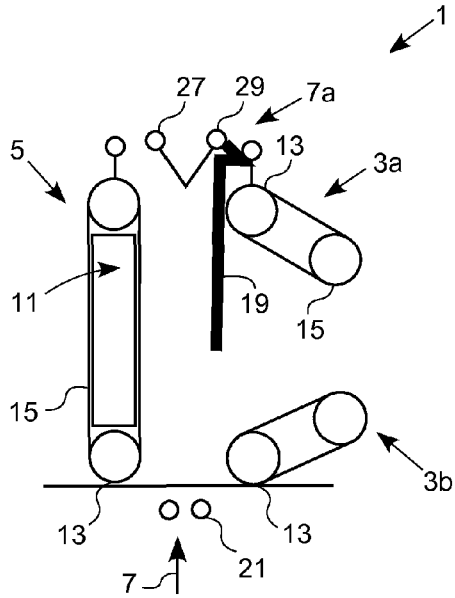
FIG. 5*b* a schematic side view of a sheet transport device in accordance with another exemplary embodiment of the present invention, said sheet transport device comprising a different pivot opening mechanism for access to a sheet transport path.
Figure 6:
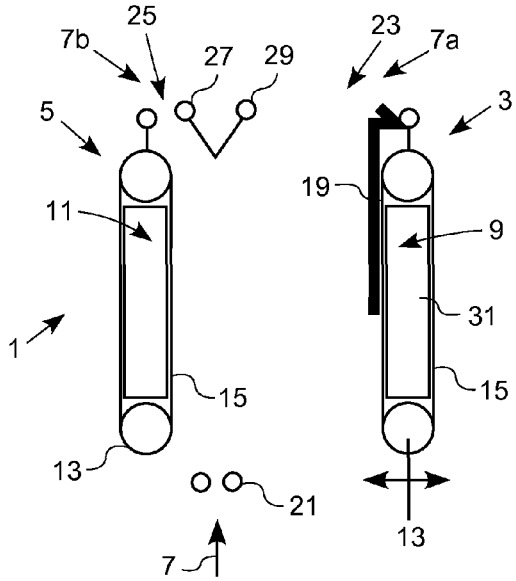
FIG. 6 a view similar to that of FIGS. 5*a* and 5*b*, however with an alternative opening mechanism.

FIGS. 5*a*, 5*b* and 6 show exemplary embodiments, wherein at least one of the transport units 3, 5 can be moved away from the sheet transport path 7. FIG. 5*a* shows an exemplary embodiment, wherein the first transport unit 3 is pivoted away from the sheet transport path 7 and from the transport unit 5 in the region of the upper transport roller 13. Thus it is easier for an operator to perform maintenance work such as, for example, eliminate a sheet jam. FIG. 5*b* shows an exemplary embodiment, wherein two transport units 3*a*, 3*b* are sequentially arranged on the right side. Consequently, this provides another alternative for access to the sheet transport path 7 and to sheets 19 that have become stuck.

FIG. 6 shows an alternative embodiment, wherein the first transport unit 3 can be linearly moved away from the sheet transport path 7. This provides another alternative for access to the sheets 19 that have become stuck in the sheet transport path 7. It is taken into consideration that the movement of the transport units 3, 5 is motor-driven. Furthermore, it is taken into consideration that, in the case of a sheet jam, the transport units 3, 5 are automatically triggered to pivot away and that a return movement in one of the transport units 3, 5 will then occur automatically in order to remove the jammed sheet.

Figure 7A:
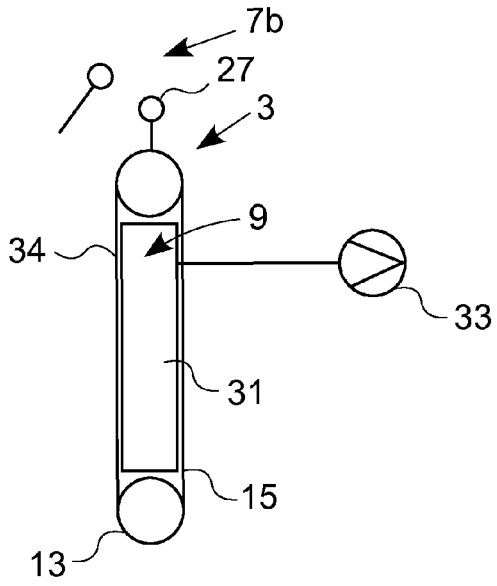
FIG. 7*a* a schematic side view of a transport unit of a sheet transport device in accordance with one exemplary embodiment of the present invention.
Figure 7B:
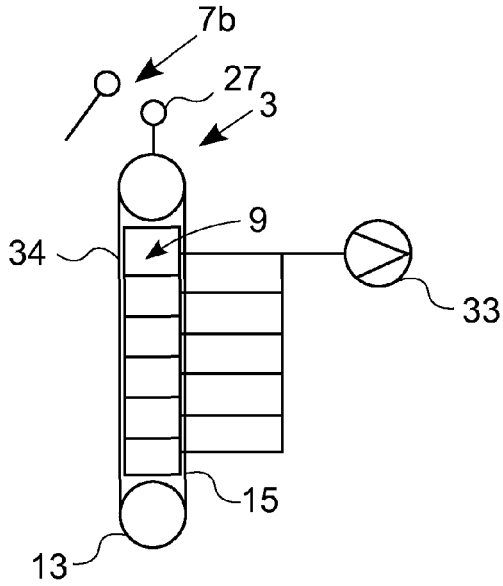
FIG. 7*b* a schematic side view of a transport unit of a sheet transport device in accordance with another exemplary embodiment of the present invention.
Figure 7C:
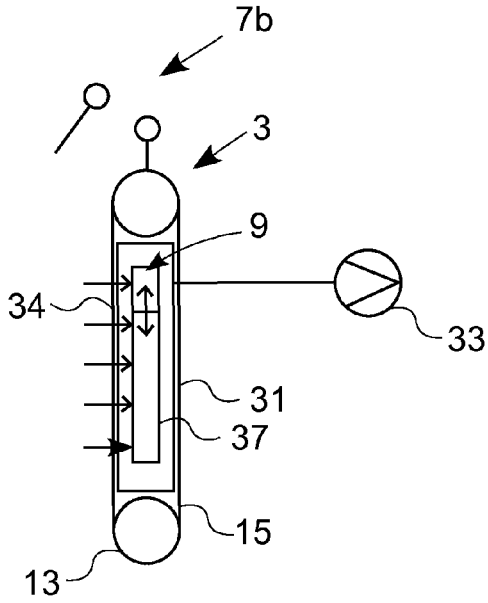
FIG. 7*c* a schematic side view of a transport unit of a sheet transport device in accordance with yet another exemplary embodiment of the present invention.

FIGS. 7*a-c* show side views of various exemplary embodiments of the vacuum suction devices 9, 11. The vacuum suction devices 9, 11 of the transport units 3, 5 comprise a suction chamber 31 that communicates with a vacuum source 33, thus causing a vacuum to prevail in the suction chamber 31. This vacuum is sufficiently strong in order to draw a sheet 19 toward one of the transport units 3, 5. The vacuum in the suction chamber 31 of each transport unit 3, 5 can be adjusted independently of the suction chamber 31 of the other transport unit 3, 5. Viewed in the direction of length, the suction chamber 31 extends essentially across the entire space between the transport rollers 13 and, viewed in the direction of width, across the width of the conveyor belt 15. The suction chamber 31 has a plurality of sheet suction openings 34 that face toward the air-transmissive conveyor belt 15 and are essentially uniformly distributed. When the vacuum source 33 is switched on, the air is sucked through the air-transmissive conveyor belt 15 and into the sheet suction openings 34.

In accordance with one exemplary embodiment, the vacuum source 33 can be variably adjusted, for example by means of a blower featuring different speeds and/or by a flap or valve control. In this kind of arrangement, the total vacuum in the suction chamber 31 changes and—overall—more or less air is sucked through the sheet suction openings 34.

In another exemplary embodiment, each of the transport units 3, 5 comprises at least one control element (not shown in the figures) that is air-transmissive, at least in partial areas. The control element can be moved into a position adjacent to the sheet suction openings 34 and has dimensions such that it is able to completely, or also only partially, cover the sheet suction openings 34. In particular, viewed in transport direction of the conveyor belt 15, the control element may sequentially cover and clear adjacent regions. Depending on its position, the control element may cover parts of the sheet suction holes 34. As a result of the covered sheet suction holes 34, it is not possible to draw in air by suction. Alternatively, the control element may also comprise partial regions that are less air-transmissive than the sheet suction openings 34. When such partial regions cover the sheet suction openings 34, the air flow is only reduced and not completely cut off as a result of this. A control web, or also adjacent flap elements in the suction chamber 31, could be used as the control element. When using the control web, for example, half of the control web may be air-tight or less air-transmissive so that, depending on the position of the control web, all the sheet suction openings 34 may be selectively free or covered.

In a further exemplary embodiment, the vacuum suction devices 9, 11 comprise suction chambers 31 having several compartments 35 with their own sheet suction openings 34 that can be selectively connected to the vacuum source 33. Consequently, a part of the compartments 35 may display a lesser vacuum than the other compartments 35.

The distribution of the vacuum in the compartments 35 can be adjusted in dependence of the position of a conveyed sheet 19. In particular the vacuum is switched off in those compartments 35, where there is no conveyed sheet 19, as is indicated by crossed-out arrows in FIGS. 1 through 4. For example, the compartments 35 are connected with the vacuum source 33 by means of separate lines or via a manifold having several valves.

In accordance with a further exemplary embodiment, the suction chamber 31 comprises a variable suction opening 37. In FIG. 7*c*, the variable suction opening 37 is shown as a variable bypass opening by way of which—in open state—additional air is aspirated, said air not being drawn by suction through the air-transmissive conveyor belt 15 and through the sheet suction openings 34. The vacuum in the suction chamber 31 varies as a function of the degree of opening of the variable suction opening 37.

Alternatively, the suction opening 37 is identical with the sheet suction openings 34. This means that the sheet suction openings 34 can be variably opened and closed, so that the vacuum suction in partial regions of the air-transmissive conveyor belt 15 may be adjusted downward.

It should be noted that a suction chamber 31 may be connected with a variable vacuum source as well as also comprise several compartments 35, and also comprise a variable suction opening 37. For example, the variable suction opening 37 may be elongated and extend over the entire length of the suction chamber 31. When the variable suction opening 37 is gradually opened, it sequentially opens several compartments 35 toward the environment. Consequently, independently of the opening degree of the variable suction opening 37, air is sucked into one or more of the compartments 35 from the environment.

In the exemplary embodiment that uses the control element, said element is aligned with the sheet 19 in such a manner that the part of the suction opening 37 that is not covered by the sheet 19 is covered by the control element. Thus air is aspirated only through the part of the conveyor belt on which the sheet 19 is located.

The strength of the vacuum and the method of application used by the vacuum suction device is adjusted as a function of the position of a sheet 19 that is to be conveyed. The position and/or the speed of the sheet 19 are detected by one or more not illustrated sheet detectors along the sheet transport path 7. These sheet detectors may be, for example, light barriers, touch-sensitive sensors, air pressure sensors, etc.

Hereinafter, the operation of the sheet transport device will be explained in greater detail. In accordance with one exemplary embodiment, the sheet transport device 1 is used to transport a sheet 19 along the sheet transport path 7 and to feed said sheet to one of the two sheet transport outlets 23, 25.

First, the sheet 19 is conveyed, coming from the sheet transport inlet 17, between the transport units 3 and 5. A vacuum is selectively applied to one of the vacuum suction devices 9, 11, while the vacuum of the other suction device is switched off. Consequently, as is shown in FIG. 1, the sheet 19 is drawn to the right toward the transport unit 3. As illustrated by the arrows in FIG. 1, a vacuum is applied to the suction chamber 31 of the right transport unit 3. As indicated by the crossed-out arrows in FIG. 1, no vacuum is applied to the suction chamber 31 of the second transport unit 5. The vacuum in the suction chamber 31 draws the sheet 19 toward the conveyor belt 15 of the right transport unit 3, and said conveyor belt then conveys the sheet 19 in the direction of the first sheet transport outlet 23. There, the sheet 19 is grasped by the opposing sheet transport output rollers 27 and continued to be conveyed.

Figure 2:
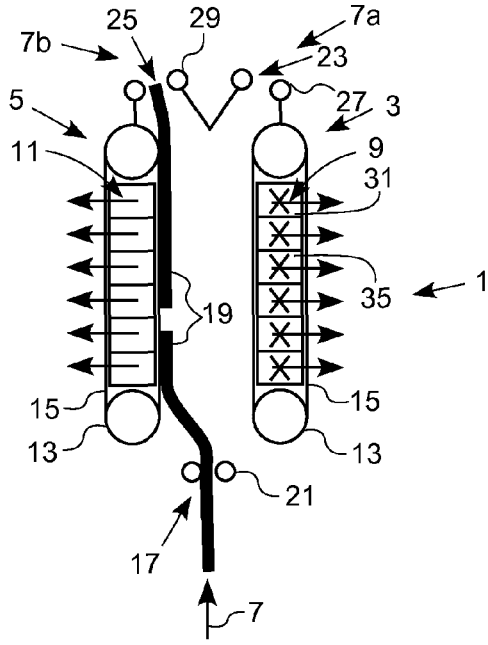
FIG. 2 a schematic side view of the sheet transport device shown in FIG. 1, in a second mode of operation.

Alternatively, as can be seen in FIG. 2, a sheet 19 transported from the sheet transport inlet 17 is pulled by vacuum toward the left transport unit 5, while the vacuum in the suction chamber 31 of the right transport unit 3 is switched off. In this case, the left transport unit 5 conveys the sheet 19 to the second sheet transport outlet 25, where said sheet is grasped by the opposing transport rollers 29 and continued to be transported.

Consequently, the sheet 19 is selectively drawn either toward the right transport unit 3 or toward the left transport unit 5, and is thus transported either to the right sheet transport outlet 23 or to the left sheet transport outlet 25. In this mode of operation, the sheet transport device 1 acts as a switch for a sheet 19 that is guided either to the sheet path 7*a* or 7*b*.

The vacuum suction devices 9, 11 of the opposing transport units 3, 5 thus feature an on-switching and an off-switching that can be logically locked with respect to each other in such a manner that a vacuum is applied to only one of the transport units 3, 5, while no vacuum or only a minimal vacuum is applied to the other transport unit 3 or 5 in the corresponding region. This means, for example, that—in a region of a conveyor belt that is covered with a sheet—a high vacuum is applied to the one transport unit, while, at the same time, a minimal vacuum is applied to the opposite region of the other conveyor belt that is not covered by a sheet. This may be achieved, for example, by flaps in the manifolds to the vacuum source 33, said manifolds being arranged in such a manner that they alternately connect a region of a transport unit 3, 5 with the vacuum source 33, while they, at the same time, cut off the opposing region of the other transport unit 3 or 5 from the vacuum source 33.

Another example of the method in accordance with the present invention allows a bypassing of a sheet around a sheet jam in a transport path 7*a* or 7*b*. The method for bypassing a sheet 19 will be explained in detail hereinafter with reference to FIG. 3.

A first sheet 19 has been conveyed from the direction of the sheet transport inlet 17 and has been transported further by the transport unit 3 to the first sheet transport outlet 23 (sheet transport path 7*a*). However, a sheet jam has occurred at the first sheet transport outlet 23 due to a problem, so that the first sheet 19 can no longer be transported further. The sheet jam and the position of the sheet 19 are detected by means of output signals of the sheet detectors.

In one exemplary embodiment, a sheet jam in the sheet transport path 7 is detected by detection of the position of a sheet 19 in the sheet transport path 7. One or more (not illustrated) detectors determine the position of a sheet 19. If the position has not changed for a certain period of time, a sheet jam is detected. In accordance with a further exemplary embodiment, a sheet jam is detected by detecting the speed of a sheet 19 in the sheet transport path 7. As soon as the speed drops below a previously specified level or the speed of the sheet 19 deviates greatly from the speed of the transport unit 3 or 5 transporting said sheet, a sheet jam is detected. Alternatively, a sheet jam is detected when the speed of the leading edge of the sheet 19 deviates from the speed of the trailing edge of the sheet 19.

Following the detection of a sheet jam, the transport unit 3 or 5, in whose region the sheet jam has occurred, is stopped. As a result of this, it is avoided that the sheet jam becomes denser or that the sheet 19 will undulate and obstruct the nip between the transport units 3 and 5.

Figure 3:
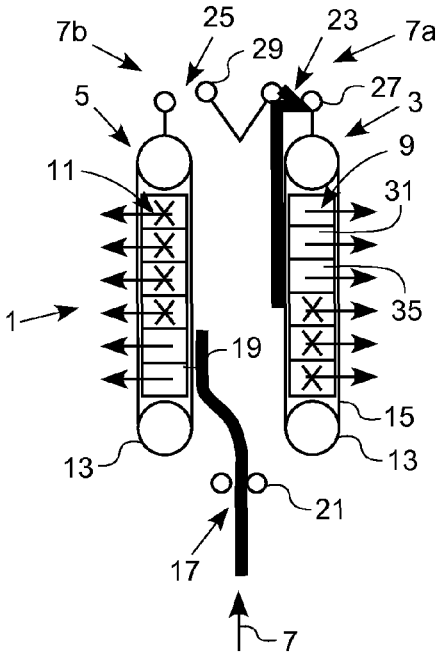
FIG. 3 a schematic side view of the sheet transport device shown in FIG. 2, in a third mode of operation in which a sheet jam occurs.

As indicated by the arrows pointing to the right in FIG. 3, the rear part of the sheet 19 that is still located in the region of the suction chamber 31 of the first transport unit 3 continues to be attracted by the vacuum in order to prevent that said rear part will lift off the transport unit 3 and thus cause additional problems. As shown by the crossed-out arrows pointing to the right in FIG. 3, the vacuum in the exposed region of the transport unit 3, however, is decreased or switched off.

Then, another sheet 19 is supplied from the direction of the sheet transport inlet 17 and is pulled—due to the vacuum—toward the left to the second transport unit 5. Thereafter, the second transport unit 5 transports the second sheet 19 in the direction of the second sheet transport outlet 25, where said sheet is grasped by the sheet transport output rollers 29 and conveyed further (sheet transport path 7*b*). Consequently the sheet jam in the first sheet transport outlet 23 can be bypassed in that the second sheet 19 is conveyed through the unobstructed transport unit 5 past the stuck first sheet 19.

Although not specifically shown in the figures, the second sheet 19 and additional subsequent sheets 19 can be conveyed further through the second transport unit 5 and the sheet transport output rollers 29 along the sheet transport path 7*b* and then be guided back to the original sheet transport path 7. Thus the sheet jam in the first sheet transport outlet 23 is bypassed, and the operation of the sheet transport device 1 need not be interrupted.

As is shown in FIG. 3 by left-pointing crossed-out arrows, the vacuum in the regions of the suction chamber 31 of the left transport unit 5 is switched off or decreased. As a result of this, it is prevented that the stuck first sheet 19 is drawn toward the second transport unit 5 and causes another sheet jam. The vacuum in the suction chamber 31 of the left transport unit 5 is at full level only in the region where the second sheet 19 is situated on the transport unit 5.

Figure 4:
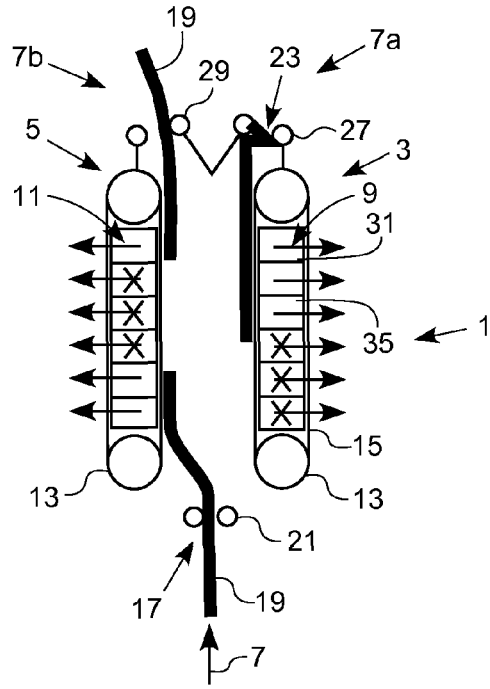
FIG. 4 a schematic side view of the sheet transport device shown in FIG. 1, said view illustrating a transport of sheets that is sustained during a sheet jam.

It should be pointed out that FIGS. 1 and 2 show a situation, in which two sheets 19 are aspirated and transported at a short distance from each other by the right transport unit 3. In this case, the vacuum in the suction chamber 31 is constant across the entire transport unit 3. In contrast, FIG. 4 shows a situation in which two sheets 19 are conveyed at a greater distance by the left transport unit 5. As is shown in FIG. 4 by the crossed-out arrows, the vacuum is switched off, or at least decreased, in the region that is not covered by one of the sheets 19.

As has already been mentioned above, the vacuum suction device of at least the transport unit 3, 5 that does not transport the sheet 19 (i.e., the transport unit 3 or 5 with the sheet jam) is partially adjusted downward while a sheet jam is being detected and while a sheet 19 is being transported. In an exemplary embodiment, this process of a downward adjustment occurs by means of a general reduction of the vacuum level of one of the vacuum suction devices 9, 11. The reduction of the vacuum level is achieved, for example, by the downward adjustment of a blower or by flaps or valves in the connection between the suction chamber 31 and the vacuum source 33.

In accordance with another exemplary embodiment, the vacuum level is reduced only in partial regions of the vacuum suction device 9, 11. In case a suction chamber 31 comprises several compartments 35, the reduction of the vacuum level displays the reduction of the vacuum in a least one of these compartments 35. Inasmuch as the compartments 35 communicate with the vacuum source, either individually or via a manifold, the change of the vacuum is achieved by opening or closing of flaps or valves in the connecting lines.

In an embodiment wherein the suction chamber 31 comprises a variable suction opening 37, the step of downward adjustment of the vacuum suction device comprises the variable opening of said suction opening 37. FIG. 7*c* shows the variable suction opening 37 as a variable bypass opening, by way of which additional air is aspirated when in open state. Additional air that has been sucked in through the bypass opening is not sucked through the air-transmissive conveyor belt 15 and through the sheet suction openings 34. As a result of this, the vacuum used for attracting the sheet 19 is decreased. The vacuum in the suction chamber 31 thus varies as a function of the opening degree of the variable suction opening 37.

Alternatively, the suction opening 37 is identical with the sheet suction openings 34. In this case, the step of downward adjustment of the vacuum suction device comprises the variable opening of the sheet suction openings 34. Thus the vacuum suction can be adjusted downward in partial regions of the air-transmissive conveyor belt 15, wherein the sheet suction openings 34 are closed further. In accordance with one embodiment, the sheet suction openings 34 are opened or closed by selectively activatable valves, slides or flaps. In accordance with another embodiment, the sheet suction openings 34 are closed or partially closed by the above-described control web.

A suction chamber 31 may communicate with a variable vacuum source, may comprise several compartments 35 and may also comprise a variable suction opening 37. In such a case, a combined actuation of these elements for adjusting the vacuum can provide great flexibility. For example, the variable suction opening 37 may be elongated and extend along the entire length of the suction chamber 31. When the variable suction opening 37 is gradually opened, said variable suction opening opens several compartments 35 in sequence toward the environment. Consequently, depending on the opening degree of the variable suction opening 37, air from the environment is sucked into one or more of the compartments 35.

The invention has been described with reference to preferred exemplary embodiments, where the individual features of the described exemplary embodiments may be freely combined and/or interchanged with each other, provided they are compatible. Numerous modifications and configurations are possible for and obvious to the person skilled in the art without a departure from the inventive idea.

The invention claimed is:

1. Sheet transport device comprising:

first and second sheet transport outlets;

first and second opposing transport units aligned with the respective transport outlets and set at a distance from each other such that one transport unit can transport a sheet independently of the other transport unit, and a sheet conveyed by one transport unit is guided in the sheet transport outlet aligned therewith; wherein each transport unit includes a circulating conveyor belt and vacuum suction device in operative arrangement with the conveyor belt;

the vacuum suction devices are individually actuatable so as to attract a sheet, located between the transport units, to the one or the other conveyor belt;

each vacuum suction device includes a mechanism for applying different vacuum pressures to different regions of the conveyor belt; and at least one of the transport units is at least partially movable away from the opposing transport unit.

2. The sheet transport device according to claim 1, wherein each vacuum suction device is adapted to sequentially apply a vacuum to adjacent regions of the corresponding conveyor belt.

3. The sheet transport device according to claim 1, each vacuum suction device including a suction chamber and a variably controllable vacuum source in communication therewith.

4. The sheet transport device according to claim 1, each vacuum suction device including a suction chamber with several partitions, the partitions being selectively connectable to a vacuum source.

5. The sheet transport device according to claim 1, each vacuum suction device including a suction chamber communicating with a vacuum source and having a suction opening that can be variably opened and closed.

6. The sheet transport device according to claim 5, wherein the suction opening includes a variable bypass opening operative to decrease the vacuum.

7. The sheet transport device according to claim 5, further including a flap, a valve, or a circulating, partially air-transmissive, control web adapted to open and close the suction opening.

8. The sheet transport device according to claim 1, each vacuum suction device including connection and disconnection features so that that a vacuum is applied to only one of the transport units in opposing regions, while no vacuum or only a minimal vacuum is applied to the other transport unit in the corresponding region.

9. The sheet transport device according to claim 1, wherein each sheet transport outlet communicates with a separate sheet transport path.

10. The sheet transport device according to claim 1, further including a sheet feeding unit arranged to convey a sheet between the first and the second transport units.

11. The sheet transport device according to claim 1, further including an additional transport unit provided after the first or the second transport unit in a transport direction of the sheets.

12. The sheet transport device according to claim 1, wherein the at least one of the transport units is adapted to pivot.

13. The sheet transport device according to claim 1, wherein the at least one of the transport units is adapted to move linearly.

14. The sheet transport device according to claim 1, further including sheet sensors for sensing a sheet position, wherein at least one if the vacuum suction devices is activated in response to output parameters of the sheet sensors.

15. A method for transporting a sheet to one of two sheet transport outlets, comprising:

providing a sheet conveyor unit and a sheet transport device, the sheet transport device including first and second transport units with circulating conveyor belts and vacuum suction devices, the devices being arranged opposite each other and spaced apart from each other;

feeding a first sheet between the two transport units;

depending on the sheet transport outlet to which a first sheet is to be conveyed, activating the vacuum suction device of the first or second transport unit to draw the first sheet by suction to the conveyor belt of the corresponding transport unit;

conveying the first sheet to the corresponding sheet transport outlet using the corresponding conveyor belt;

detecting a sheet jam in the region of the corresponding transport unit, whereby the corresponding transport unit is an obstructed transport unit and the other of the first and second transport units is an unobstructed transport unit;

feeding a second sheet between the two transport units; and conveying the second sheet using the unobstructed transport unit.

16. The method according to claim 15, wherein the detecting step includes measuring the position of a sheet.

17. The method according to claim 15, wherein the detecting step includes measuring the speed of a sheet.

18. The method according to claim 15, wherein the detecting step includes stopping the transport unit having the sheet jam.

19. The method according to claim 15, further including adjusting downward, at least partially, the vacuum suction device of the transport unit that does not transport the sheet.

20. The method according to claim 19, wherein the adjusting step includes reducing the vacuum level.

21. The method according to claim 19, wherein the adjusting step includes reducing the vacuum level in partial regions of the vacuum suction device.

22. The method according to claim 15, wherein the vacuum suction device includes a suction chamber with several partitions, and adjusting step includes reducing the vacuum at least in one of the partitions.

23. The method according to claim 22, wherein the vacuum suction device has a suction chamber with a variable suction opening, and the adjusting step includes variably opening the suction opening.

* * * * *